US011519618B1

(12) United States Patent
White

(10) Patent No.: US 11,519,618 B1
(45) Date of Patent: Dec. 6, 2022

(54) FOUNDATION DRYER VENT

(71) Applicant: Gregory White, Vero Beach, FL (US)

(72) Inventor: Gregory White, Vero Beach, FL (US)

( * ) Notice: Subject to any disclaimer, the term of this patent is extended or adjusted under 35 U.S.C. 154(b) by 0 days.

(21) Appl. No.: 17/177,655

(22) Filed: Feb. 17, 2021

(51) Int. Cl.
*F24F 7/04* (2006.01)
*F24F 7/00* (2021.01)

(52) U.S. Cl.
CPC ..... *F24F 7/04* (2013.01); *F24F 2007/0025* (2021.01)

(58) Field of Classification Search
CPC .. E04B 1/70; E04B 1/7076; F24F 2007/0025; F24F 7/04
USPC ..... 454/367, 359
See application file for complete search history.

(56) References Cited

U.S. PATENT DOCUMENTS 2,047,714 A * 7/1936 Smith ..... F16L 33/16 285/402
2,348,155 A * 5/1944 SHanley ..... B22C 1/167 501/129
2,722,170 A * 11/1955 Broberg ..... F24F 13/00 454/332
2,754,748 A * 7/1956 Daggett ..... F24F 7/00 454/359
2,861,510 A * 11/1958 Wulle ..... F24F 13/068 285/376
3,200,734 A * 8/1965 Burns ..... E04B 9/0442 454/297
3,233,923 A * 2/1966 Raider ..... F16L 33/24 285/239
3,285,155 A * 11/1966 Maltenfort ..... F24F 13/08 454/359
3,596,936 A * 8/1971 Dieckmann ..... F16L 59/18 285/423
3,915,477 A * 10/1975 Timmons ..... F16L 41/08 285/391
4,081,915 A * 4/1978 Materniak nee Babcerowicz ..... D06F 58/20 34/235
4,151,789 A * 5/1979 Grobard ..... F16L 37/008 403/349
4,214,380 A * 7/1980 Meyer ..... D06F 58/20 34/235
4,274,330 A * 6/1981 Witten ..... F24F 7/00 248/27.1
5,080,403 A * 1/1992 Paoluccio ..... F16L 41/00 285/189
5,383,816 A * 1/1995 Marcello ..... F24F 13/10 454/363
5,397,157 A * 3/1995 Hempel ..... F02M 35/10137 285/227
5,482,507 A * 1/1996 Priest ..... F24F 13/075 34/235

(Continued)

*Primary Examiner* — Edelmira Bosques
*Assistant Examiner* — Frances F. Hamilton
(74) *Attorney, Agent, or Firm* — Malin Haley DiMaggio & Bowen, P.A.

(57) ABSTRACT

A method of installing a dryer vent in a building exterior foundation wall during construction of the building. The dryer vent installation method comprises mounting a rigid wall plate that includes a fastener tube, the fastener tube includes outwardly facing pins. The dryer vent installation method includes mounting a removable flapper housing with mounting slots, the housing including a flapper valve. The dryer vent installation method further includes removably fastening the flapper valve housing slots to the fastener tube pins.

2 Claims, 4 Drawing Sheets

(56) References Cited

U.S. PATENT DOCUMENTS 5,487,701 A * 1/1996 Schedegger ..... F24F 13/08 52/302.1
5,722,181 A * 3/1998 Meyer ..... D06F 58/20 34/235
5,916,023 A * 6/1999 Meyer ..... D06F 58/14 454/359
5,957,373 A * 9/1999 Sarazen, Jr. ..... F24F 11/76 454/258
6,131,958 A * 10/2000 Craig ..... F16L 37/248 285/136.1
6,370,794 B1 * 4/2002 Tuggle ..... D06F 58/20 454/270
6,443,834 B1 * 9/2002 Berger ..... F24F 13/06 454/353
6,468,054 B1 * 10/2002 Anthony ..... F04D 25/12 454/239
6,780,100 B1 * 8/2004 Gretz ..... F24F 7/00 454/359
6,817,942 B1 * 11/2004 Betz ..... F24F 7/00 454/271
7,040,979 B1 * 5/2006 Betz ..... E04B 1/7076 454/271
7,128,643 B2 * 10/2006 Beliveau ..... F24F 13/085 454/271
7,421,803 B2 * 9/2008 Charron ..... E04F 17/04 34/235
7,600,944 B1 * 10/2009 Keating ..... E04H 9/145 405/96
7,780,509 B1 * 8/2010 Hoaks ..... F24F 13/084 454/274
7,814,707 B1 * 10/2010 Hurst ..... E06B 5/01 49/504
8,240,093 B2 * 8/2012 Lajewski ..... F24F 7/00 52/302.3
8,308,396 B2 * 11/2012 Shook ..... E04B 1/7076 405/100
8,425,288 B1 * 4/2013 Snipes, Jr. ..... F24F 13/082 454/271
10,876,757 B2 * 12/2020 Volpe ..... F24F 13/0245
2005/0003755 A1 * 1/2005 Koessler ..... F24F 13/08 454/359
2005/0202778 A1 * 9/2005 Stravitz ..... F24F 13/082 34/235
2005/0266791 A1 * 12/2005 Beliveau ..... E04B 1/7076 454/271
2011/0133357 A1 * 6/2011 Ness ..... B28B 7/366 264/123
2012/0071083 A1 * 3/2012 Gribble ..... F24F 13/10 454/333
2015/0121786 A1 * 5/2015 Carr ..... E04B 1/7076 52/302.1

* cited by examiner

FOUNDATION DRYER VENT

BACKGROUND OF THE INVENTION

1. Field of the Invention

This invention relates generally to a clothes dryer vent, mounted through the exterior wall of a residential or commercial building, to allow the clothes dryer hot exhaust air to be transmitted from indoors through the vent to the outdoors.

Specifically, the invention provides for the installation of the dryer vent during the initial construction of a residential or commercial building, greatly reducing the cost and any building later modifications, when installing a dryer vent.

2. Description of Related Art

The use of a clothes dryer, especially in a basement or utility room of a residential building is well known. It is very desirable to provide a hot air exhaust system for the removal of the hot moist air, generated by a dryer during operation, to the outdoors of the residential building. Once a residence is built, especially on a concrete block foundation, it is often very expensive and requires drilling and construction modification of the exterior wall of the building in order to provide a sufficiently sized passage for the hot exhaust air to pass from indoors to outdoors.

The dryer vent disclosed herein, as the invention, greatly reduces the problem and the costs associated with constructing a dryer vent through an existing exterior wall of a building. In lieu of drilling through the wood side wall on wood frame structure built on a conventional foundations, the invention is mounted in the foundation, when the building is constructed. With the invention disclosed herein, the dryer vent is installed at the time the building is constructed, preferably in a foundation wall, greatly reducing future problems and costs that could arise putting a dryer vent through an existing wall structure.

BRIEF SUMMARY OF THE INVENTION

A foundation dryer vent that is installed in a building foundation or exterior wall when the building is constructed. This dryer vent installation alleviates a future requirement to create an access passage through an existing building exterior wall that can be an expensive and somewhat destructive action at a later time.

The foundation dryer vent comprises a rigid, rectangular plate, sized in length and width to be equivalent to a concrete masonry unit (CMU). Throughout the specification, concrete blocks have synonymously used terms including "CMUs, cement blocks, foundation blocks, and construction foundation (CMU) blocks". The rigid plate has a large circular aperture at its center. The rigid rectangular plate has parallel left and right vertical sides, with each vertical side edge (and the bottom side edge) having a different thickness than the main body of the rigid plate so that the vertical side edges can fit snugly into keyed concrete block slots during installation of the dryer vent of the construction of the building foundation wall.

The rigid plate has an exterior surface that faces outwardly on the exterior side of a building foundation wall and an interior surface that will face the interior of a building, when installed.

On the interior surface side of the rigid plate, representing the inside of a building, a truncated conical tube is permanently affixed to the rigid plate, around the circular aperture, perpendicular to the plate surface. The purpose of the truncated conical tube is to allow it to be physically attached to the vent exhaust hose from a clothes dryer. The tapered truncated tube conical shape allows easier installation of a dryer exhaust hose to be fastened tightly by a hose clamp to the truncated conical tube for operation.

The building exterior facing surface of the rigid plate includes a short fixed central plastic fastener tube having outwardly extending knurled pins and the fastener tube is attached perpendicularly around the rigid plate center circular aperture, the purpose of the central fastener tube is to connect to a flapper valve and housing fastener tube having a pair of bayonet slots, allowing the flapper valve to be attached to the rigid plate fastener tube knurled pins, but removable for cleaning.

One of the components of the foundation dryer vent is a (building exterior) removable flapper valve connected to a flapper valve housing that is rectangular, and a flapper valve housing fastener tube that includes a bayonet fastener that allows the flapper valve and its housing to be removably attachable to the rigid plate, allowing for cleaning of the flapper valve when necessary. The flapper valve housing and its fastener tube with a bayonet fastener pin slot can be easily manually attached to the exterior facing surface of the rigid plate which has a fastener tube with a pair of knurled pins that can be rotatably fastened into the bayonet slots of the flapper valve fastener tube.

The foundation dryer vent also includes a cage that is removably attachable to the flapper valve rectangular housing to prevent insects and vermin from entering into the dryer vent, so that undesirable creatures cannot get into the interior of the building at any time. The cage does not interfere in any way with the operation of the flapper valve, when opening when the dryer is on, exhausting air to the building exterior because the cage extends away from the exterior surface of the flapper valve housing, preventing any engagement with the flapper valve.

The rectangular rigid plate can be constructed of molded plastic or metal. The remaining components of the invention, including the building interior facing conical truncated tube that is firmly attached to the building interior facing surface of the rigid plate (surrounding the rigid plate circular aperture) is typically made of plastic. The fastener tube on the building exterior facing surface of the rigid plate that also surrounds the central circular aperture and is affixed thereto is also a plastic tube. The essentially circular flapper valve and flapper valve rectangular housing are also made of plastic.

Once the foundation dryer vent is constructed, the device is installed at a selected location in a building foundation during the construction of the building. In a building foundation wall being made of concrete blocks, the proper location of the dryer vent is selected and when that location is being constructed of concrete blocks, the rigid plate forming the dryer vent will be inserted between two horizontal keyed blocks or regular CMU blocks, each having a vertical receiving slot for attaching one end edge of the rigid plate thereto. The remaining foundation wall will be constructed around the concrete blocks and the rigid plate for the dryer vent.

The length and width of the rigid plate can be varied depending on different types of building foundations that may require a different size rigid plate for integration with the block housing or construction of the foundation wall. In some areas it may be desirable to have a half-block sized rigid plate which would still accommodate a dryer vent that may be 8 inches in length instead of 16 inches in length, when installed in the block foundation.

It is an object of this invention to reduce the cost and alleviate grinding and drilling through a foundation wall in order to install a clothes dryer vent from a building interior to vent dryer hot exhaust air to the outdoors on the exterior of the building by installing the dryer vent during the initial construction of the building foundation exterior wall. The foundation dryer vent is designed to be placed in the top coarse of the stem wall construction.

BRIEF DESCRIPTION OF THE DIFFERENT VIEWS OF THE DRAWINGS

DETAILED DESCRIPTION OF THE INVENTION

Figure 1A:
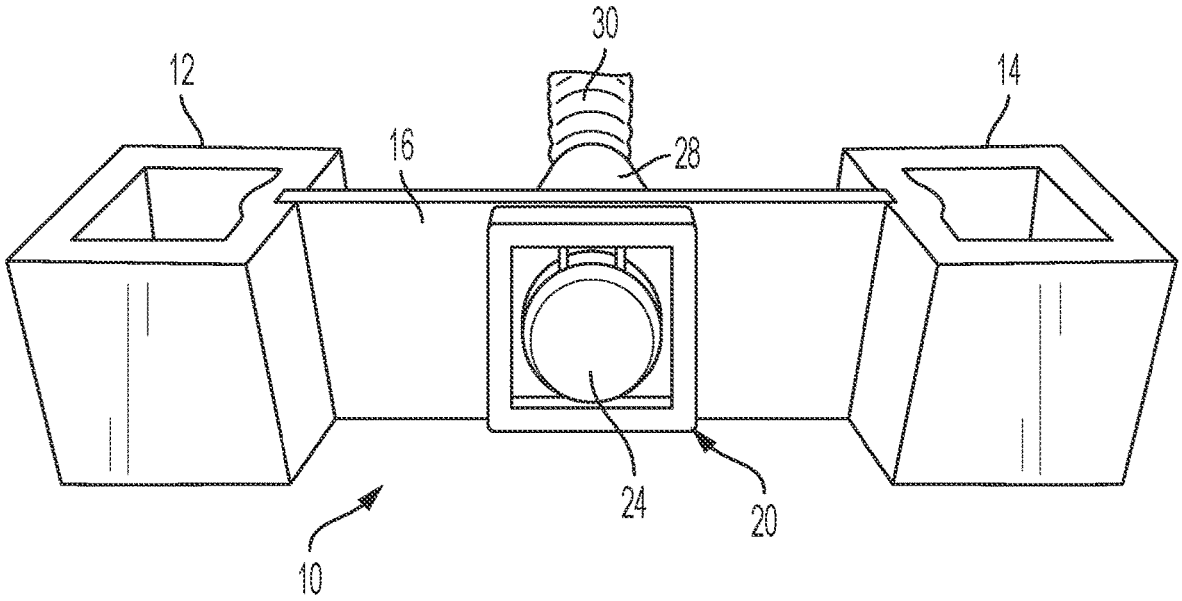
FIG. 1A is an exterior front perspective view of the invention shown mounted between two building foundation blocks.
Figure 1B:
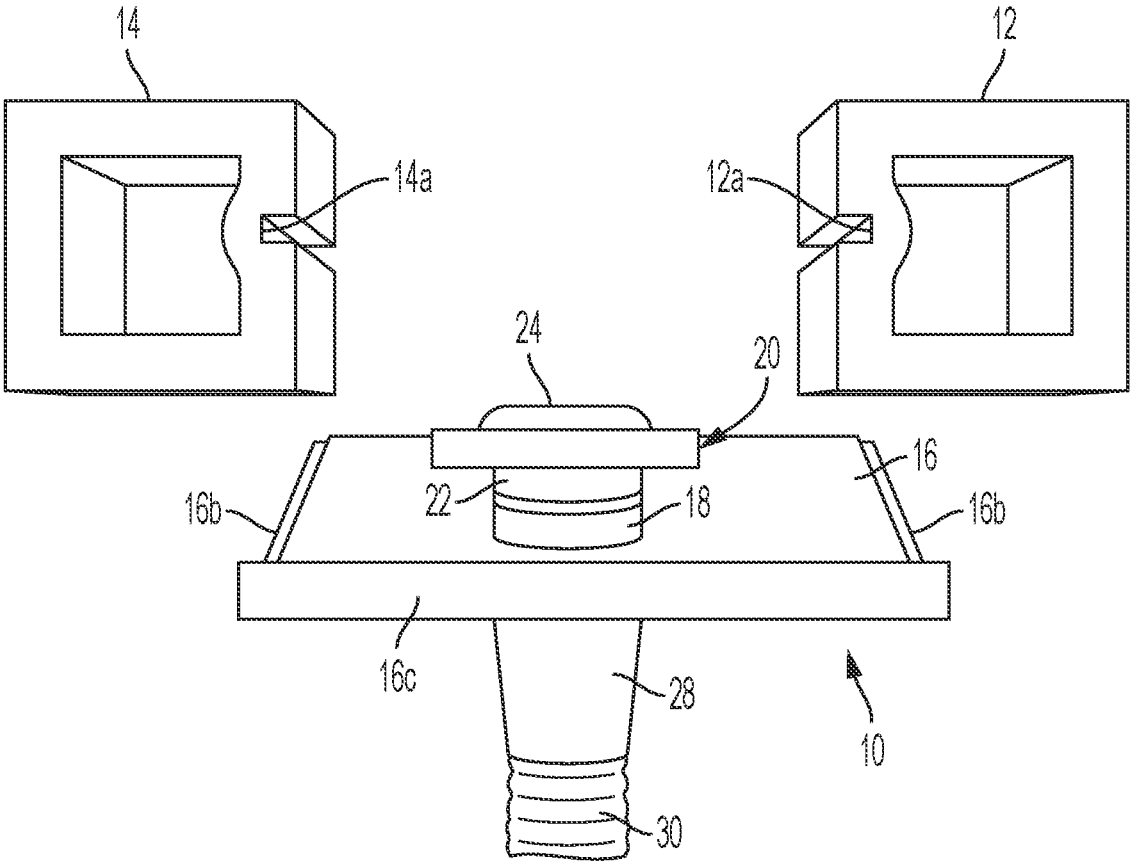
FIG. 1B is a top plan view partially in perspective of the invention positioned adjacent to foundation blocks prior to insertion.

Referring now to the drawings, and in particular, FIG. 1A and FIG. 1B, the invention 10 is shown mounted between a pair of concrete blocks 12 and 14. FIG. 1 is to illustrate how the invention 10 comprising the dryer vent is installed during construction of a building foundation between a pair of blocks 12 and 14. The rectangular length and width of the invention 10 is sized so that the rigid plate 16 is an appropriate block size and that the rigid plate 16 can fit tightly and permanently between rows of blocks, above and below the invention 10, and from side to side, between a pair of concrete blocks 12 and 14. As shown in FIG. 1A, the view is as seen from the exterior of the building. For this exterior view in FIG. 1A, a cage (FIG. 2), typically placed over the flapper valve housing 20 and flapper valve 24 opening, is not shown. A truncated conical tube 28 is molded or attached to rigid plate 16 on the building interior side of plate 16 and a dryer exhaust hose 30 is attached to the dryer vent.

FIG. 1B shows a top view of the representation of FIG. 1A, illustrating the slots 12*a* and 14*a* in block 12 and block 14 that receive the side vertical edges 16*b* of the rigid plate 16. Invention 10, as shown, includes the rigid plate 16, having a flapper valve housing 20 facing outwardly on the exterior of a building connected by fastener tube 18 to flapper valve housing fastener tube 22. A truncated conical tube 28 is connected to rigid plate 16 and is facing into the interior of a building, that is connected to a segment of a clothes dryer exhaust hose 30. The illustration of FIG. 1B is to show, from a top view, how the dryer vent invention 10 can be positioned downwardly between two keyed blocks 12 and 14 having vertical slots 12*a* and 14*a*, during the construction of the building, to permanently mount the dryer vent 10 into a building foundation.

Figure 2:
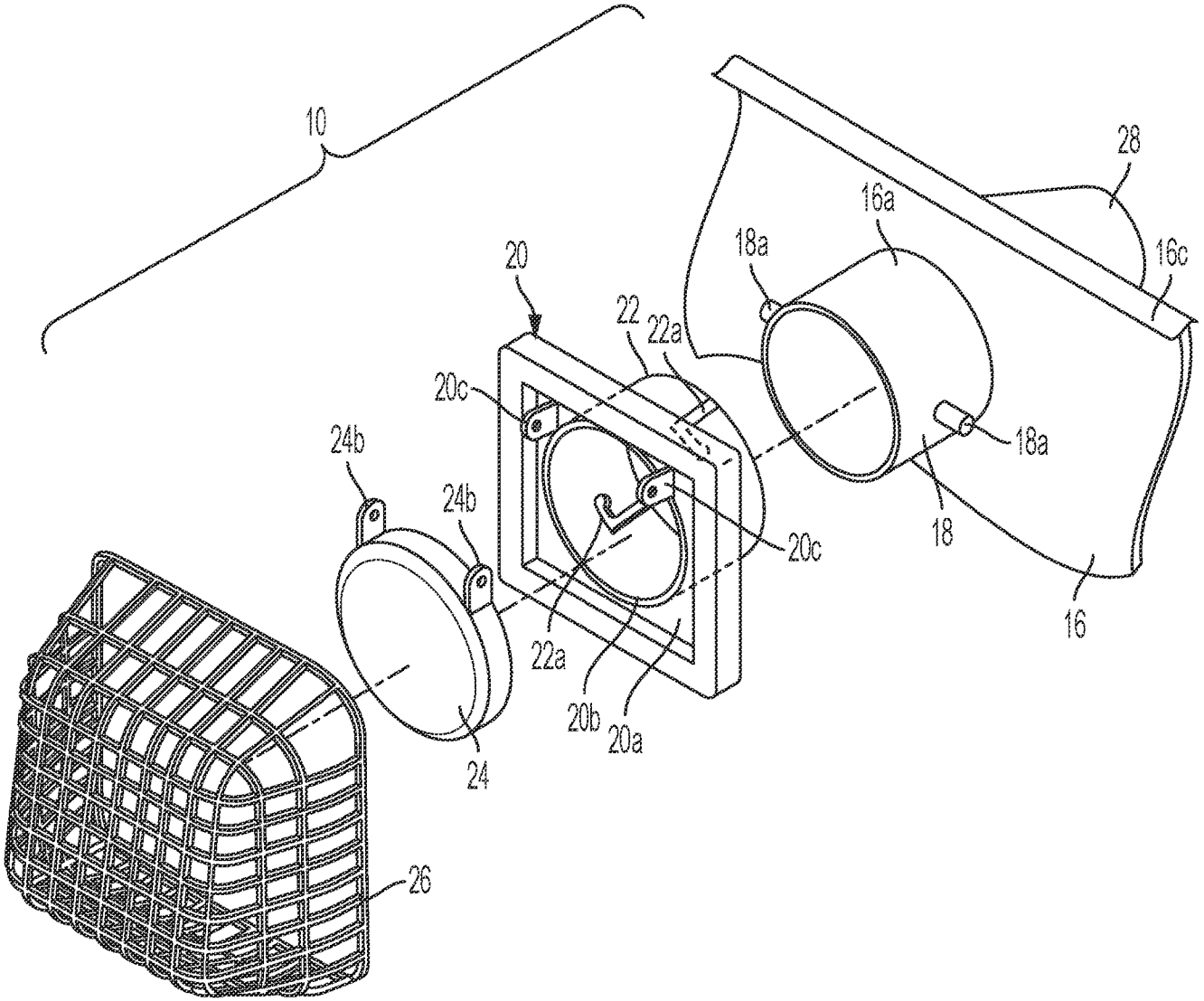
FIG. 2 is a perspective exploded view of the invention.

Referring now to FIG. 2, the invention 10 is shown comprised of a rigid plate 16 (cutaway) that is actually rectangular in shape and preferably sized approximately 16 inches×8 inches, equivalent to the length and height of a foundation cement block. The rigid plate 16 has a central circular aperture or opening 16*a* passing there through. The plate opening 16*a* is encircled by perpendicularly attached (or molded thereto) interior and exterior facing hot air exhaust tubes 28 and 18 that provide the passage for hot exhaust air from a clothes dryer from the interior of a building to the exterior of a building.

On the interior side of a building there is a truncated conical (tapered) tube 28 that has a larger diameter on the end that is rigidly attached around the rigid plate central opening 16*a* attached perpendicularly and permanently to the rigid plate 16. The purpose of the truncated conical tube 28 is to allow easy attachment to an exhaust hose of a conventional clothes dryer inside a building. With a tapered conical outside surface, the open end of the truncated conical exhaust tube 28 can be manually engaged by pushing a dryer exhaust hose over and against truncated conical tube 26 end until a tight exhaust hose diameter fit is achieved. A circular metal clamp can be installed to attach the exhaust hose firmly to the dryer vent.

On the building exterior facing side of plate 16 (outside a building), there is a rigid plate fastener tube 18 molded or permanently mounted around central circular opening 16*a* of the rigid plate 16. Fastener tube 18 has two knurled pins 18*a*, perpendicularly attached, oppositely, facing outwardly, to allow manual fastening rigid plate 16 and fastener tube 18 to a removable flapper valve housing 20 that includes a flapper valve housing fastener tube 22 with two bayonet slots 22*a* that can be manually rotated to receive and engage the rigid plate fastener tube 18 two knurled pins 18*a*.

The flapper valve housing 20 has a rectangular frame connected to rectangular wall 20*a* having a circular aperture 20*b* there through and surrounded by tubular fastener 20 having two bayonet slots 20*b*, rigidly attached thereto. The flapper valve 24 has pivotal fasteners 24*b* to connect the flapper valve 24 to pivotally mounted over flapper valve opening 20*b* and to rigid housing wall 20*a* and flapper valve fastener connectors 20*c* fixed to flapper valve housing wall 20*a*. The flapper valve housing 20 and fastener tube 22 permit the flapper valve housing 20 to be easily attached or removed from plate wall 16 and fastener tube 18 by rotation manually of the tubular fastener bayonet slots 22*a* from knurled pins 18*a* into and out of the bayonet slots 22*a* in the fastener tube 22. The purpose of this removal and attachment is to allow the flapper valve 24 and its housing 20 to be removed at any time for cleaning purposes, while easily attached once cleaning has been accomplished. Suitable fasteners can be used in place of the knurled pins and bayonet slots.

In normal operation, the flapper valve 24 and its housing 20 is firmly attached to the rigid plate 16 by the knurled pins 18*a* and fastener tube bayonet slots 22*a* so that the flapper valve 24 is closed by gravity, but when exhaust air from the dryer exhaust system strikes flapper valve 24, the flapper valve 24 is force to pivot open, to allow the exhaust air from the dryer to be disbursed at the exterior of the building, outdoors.

A cage 26 as shown in FIG. 2 can be removably attached and is rectangular around its exterior portion for attachment to flapper valve housing 20 during normal operation. The cage 26 is removable manually for cleaning. The purpose of the cage 26 is to prevent any type of outdoor creatures such as mice or vermin from getting into the dryer vent exhaust system when the flapper valve 24 is open.

Figure 3:
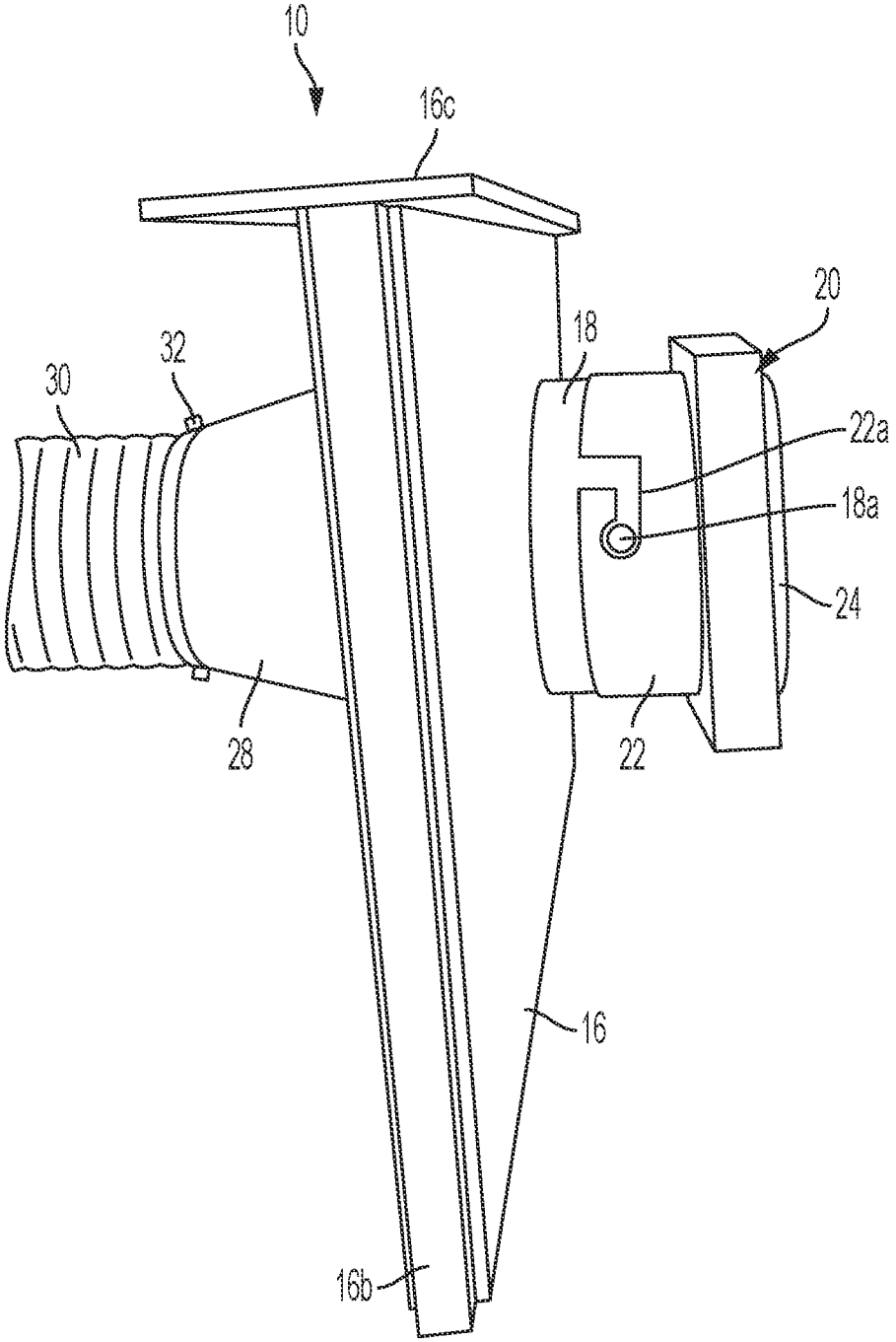
FIG. 3 is a side elevational view of the invention, partially in perspective.

FIG. 3 shows rigid plate 16, preferably of molded plastic, that can be sized 16 inches by 8 inches, having vertical side edges 16*b* that are wider (one-half inch thick each in one embodiment) than the thickness (one-quarter inch) of rigid wall 16 for fitting snuggly into the keyed slots of keyed construction foundation (CMU) blocks as shown in FIGS. 1A and 1B. A rigid top flat ledge 16*c* extends horizontally away from all rigid plate surfaces to rest on surrounding blocks when installed in a foundation wall. The dimensions of rigid plate 16 can vary depending on the building exterior wall or foundation wall that will house the dryer vent unit. For example, the rigid plate could be 8 inches by 8 inches as a half block installation.

FIG. 3 shows rigid plate 16 fastener tube 18 firmly connected to flapper valve housing 20 by flapper valve housing fastener tube 22 by the knurled pins 18*a* positioned in bayonet slots 22*a*, holding the removable flapper valve 24 and its housing 20 in place for operation of the dryer vent 10. The flapper valve housing 20 can be manually removed for cleaning. The cage 26 (FIG. 2) is not shown in FIG. 3. On the building interior, the dryer exhaust hose 30 is connected to the truncated conical tube 28 a hose clamp 32, that is conventional, wrapped around and over the exhaust hose 32 and truncated conical tube 28.

The entire invention 10 shown in FIG. 2 and FIG. 3 in can be installed in a building foundation wall or exterior wall during the construction of the building. Once the rigid plate 16 is inserted between a pair of keyed blocks and foundation blocks built around the plate 16, the flapper valve housing 20 and flapper valve housing fastener tube 22 are manually pushed and twisted onto rigid plate fastener tube 18 and knurled pins 18*a* in the bayonet slots 22*a* as explained above. The cage 26 is then attached to cover the flapper valve 24 when open. From the initial construction of the building, the dryer vent is installed for future use when the building becomes operational. Nothing further needs to be done for the attachment of a clothes dryer and exhaust hose that is installed later in the building, when operational. By installing the dryer vent in the building as is it is being constructed, a large expense is saved and any further destruction to the building exterior wall or the building foundation is eliminated.

In another embodiment of the invention, the rigid plate remains a solid plate, without any openings. The frame dimensions remain the same, offered in 8 inches and 16 inches. The solid plate thicknesses could vary from one-eight inch to three-quarters of an inch. The purpose of the invention, as initially installed in a foundation or exterior building wall in CMU construction, allows for quick and easy drilling though vinyl-plastics as opposed to chipping or drilling though a CMU wall. This provides for venting a multitude of items including air exchange pipes of oil/gas heaters, venting tank-less water heaters, and kitchen exhaust fans/hoods.

In another embodiment, the invention could be used for CMU or exterior building wall construction to provide a vent for bathroom fan exhausts. The invention is installed during building foundation construction. This embodiment of the invention can be constructed without the removable structure of the flapper valve housing, since cleaning of a flapper valve for bathroom exhaust fans would not be a problem. This embodiment can be an eight inch plate with a single port and a sixteen inch plate with a single or dual ports for CMU construction.

The present embodiments are therefore to be considered in all respects as illustrative and not restrictive, and all changes coming in the meaning and equivalency range of the pending claims are intended to be embraced therein.

What is claimed is:

1. A method of installing a clothes dryer exhaust air vent that provides a path for dryer exhaust air from inside a building to outside the building comprising the steps of:

a) constructing a building foundation wall of concrete masonry units CMUs, and during construction of said building foundation wall of concrete masonry units, selecting a building foundation wall location for mounting the clothes dryer exhaust air vent having a rigid wall plate on one side of having a fastener tube with exterior knurled fastening pins extending outwardly said rigid wall plate connected with a central circular clothes dryer exhaust vent passage and first and second parallel, vertical opposing sides between CMUs as part of the foundation wall;

b) mounting and engaging the clothes dryer exhaust air vent having said rigid wall plate first and second vertical sides at the selected location on the foundation wall between two concrete blocks in the building foundation wall of concrete masonry units; and c) completing the construction of the foundation wall that includes the clothes dryer exhaust air vent having the rigid wall plate affixed to the foundation wall;

d) providing the clothes dryer exhaust air vent with a flapper valve connected to a flapper valve housing having a flapper valve housing fastener tube that include fastener bayonet slots, that is rotatably connectable to and removable from said rigid wall plate fastener tube and the knurled fastening pins for cleaning the flapper valve;

e) providing the clothes dryer exhaust air vent flapper valve housing with a cage attached to said flapper valve housing to prevent animals from entering the dryer vent; and f) providing a clothes dryer exhaust air vent truncated conical tube connected to one side of said rigid wall plate perpendicular and covering said rigid wall plate central passage for attachment to a clothes dryer exhaust air hose.

2. The method as in claim 1, including the step of:

g) attaching the clothes dryer exhaust air hose to said dryer vent truncated conical tube.

* * * * *